US010706865B2

(12) United States Patent
Ravelli et al.

(10) Patent No.: US 10,706,865 B2
(45) Date of Patent: Jul. 7, 2020

(54) APPARATUS AND METHOD FOR SELECTING ONE OF A FIRST ENCODING ALGORITHM AND A SECOND ENCODING ALGORITHM USING HARMONICS REDUCTION

(71) Applicant: Fraunhofer-Gesellschaft zur Foerderung der angewandten Forschung e.V., Munich (DE)

(72) Inventors: Emmanuel Ravelli, Erlangen (DE); Markus Multrus, Nuremberg (DE); Stefan Doehla, Erlangen (DE); Bernhard Grill, Lauf (DE); Manuel Jander, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 16/256,937

(22) Filed: Jan. 24, 2019

(65) Prior Publication Data

US 2019/0272839 A1 Sep. 5, 2019

Related U.S. Application Data

(63) Continuation of application No. 15/644,040, filed on Jul. 7, 2017, now Pat. No. 10,224,052, which is a (Continued)

(30) Foreign Application Priority Data

Jul. 28, 2014 (EP) ..... 14178809

(51) Int. Cl.
*G10L 19/22* (2013.01)
*G10L 19/03* (2013.01)
(Continued)

(52) U.S. Cl.
CPC ..... *G10L 19/22* (2013.01); *G10L 19/032* (2013.01); *G10L 19/09* (2013.01); *G10L 19/12* (2013.01);
(Continued)

(58) Field of Classification Search
CPC ..... G10L 19/04; G10L 19/09; G10L 19/18; G10L 19/20; G10L 19/22; G10L 19/26;
(Continued)

(56) References Cited

U.S. PATENT DOCUMENTS 5,012,517 A 4/1991 Wilson et al.
5,533,052 A 7/1996 Bhaskar
(Continued)

FOREIGN PATENT DOCUMENTS

CA 2899013 * 8/2014 ..... G10L 19/18
CN 1708997 A 12/2005
(Continued)

OTHER PUBLICATIONS

3GPP, "Universal Mobile Telecommunications System (UMTS); Audio codec processing functions; extended Adaptive Multi-Rate-Wideband", (AMR-WB+) codec; Transcoding functions (3GPP TS 26.290 version 6.1.0 Release 6), 2004, pp. 1-87.
(Continued)

*Primary Examiner* — Martin Lerner
(74) *Attorney, Agent, or Firm* — Perkins Coie LLP; Michael A. Glenn

(57) ABSTRACT

An apparatus for selecting one of a first encoding algorithm and a second encoding algorithm includes a filter configured to receive the audio signal, to reduce the amplitude of harmonics in the audio signal and to output a filtered version of the audio signal. First and second estimators are provided for estimating first and second quality measures in the form of SNRs of segmented SNRs associated with the first and
(Continued)

second encoding algorithms without actually encoding and decoding the portion of the audio signal using the first and second encoding algorithms. A controller is provided for selecting the first encoding algorithm or the second encoding algorithm based on a comparison between the first quality measure and the second quality measure.

14 Claims, 4 Drawing Sheets

Related U.S. Application Data continuation of application No. 14/947,746, filed on Nov. 20, 2015, now Pat. No. 9,818,421, which is a continuation of application No. PCT/EP2015/066677, filed on Jul. 21, 2015.

(51) Int. Cl.

| | |
|---|---|
| ***G10L 19/09*** | (2013.01) |
| ***G10L 19/032*** | (2013.01) |
| ***G10L 19/12*** | (2013.01) |
| ***G10L 19/26*** | (2013.01) |
| *G10L 19/02* | (2013.01) |
| *G10L 19/08* | (2013.01) |
| *G10L 19/00* | (2013.01) |

(52) U.S. Cl.
CPC ..... *G10L 19/265* (2013.01); *G10L 19/0212* (2013.01); *G10L 19/08* (2013.01); *G10L 2019/0002* (2013.01); *G10L 2019/0011* (2013.01)

(58) Field of Classification Search
CPC ..... G10L 2019/0001; G10L 2019/0011; G10L 19/03
USPC ..... 704/203, 205, 206, 219, 220, 221, 225, 704/500, 501, 226, 227
See application file for complete search history.

(56) References Cited

U.S. PATENT DOCUMENTS

| | | | |
|---|---|---|---|
| 5,999,899 | A | 12/1999 | Robinson |
| 7,191,136 | B2 | 3/2007 | Sinha et al. |
| 7,353,168 | B2 | 4/2008 | Thyssen et al. |
| 7,739,120 | B2 | 6/2010 | Makinen |
| 7,747,430 | B2 | 6/2010 | Makinen |
| 7,933,769 | B2 | 4/2011 | Bessette |
| 8,090,573 | B2 | 1/2012 | Manjunath et al. |
| 8,275,626 | B2 | 9/2012 | Neuendorf et al. |
| 8,321,210 | B2 | 11/2012 | Grill et al. |
| 8,422,708 | B2 | 4/2013 | Elmedyb et al. |
| 8,447,620 | B2 | 5/2013 | Neuendorf et al. |
| 8,682,652 | B2 | 3/2014 | Herre et al. |
| 8,706,480 | B2 | 4/2014 | Herre et al. |
| 8,744,843 | B2 | 6/2014 | Geiger et al. |
| 9,818,421 | B2 | 11/2017 | Ravelli et al. |
| 10,224,052 | B2 * | 3/2019 | Ravelli ..... G10L 19/032 |
| 2004/0174984 | A1 | 9/2004 | Jabri et al. |
| 2005/0091046 | A1 | 4/2005 | Thyssen et al. |
| 2006/0136199 | A1 | 6/2006 | Nongpiur et al. |
| 2007/0225971 | A1 | 9/2007 | Bessette |
| 2008/0004869 | A1 | 1/2008 | Herre et al. |
| 2008/0312914 | A1 | 12/2008 | Rajendran et al. |
| 2009/0012797 | A1 | 1/2009 | Boehm et al. |
| 2009/0325524 | A1 | 12/2009 | Oh et al. |
| 2010/0262420 | A1 | 10/2010 | Herre et al. |
| 2011/0173010 | A1 | 7/2011 | Lecomte et al. |
| 2011/0178795 | A1 | 7/2011 | Bayer et al. |
| 2011/0200125 | A1 | 8/2011 | Multrus et al. |
| 2011/0202353 | A1 | 8/2011 | Neuendorf et al. |
| 2011/0257981 | A1 | 10/2011 | Beack et al. |
| 2013/0064383 | A1 | 3/2013 | Schnell et al. |
| 2013/0096930 | A1 | 4/2013 | Neuendorf et al. |
| 2013/0332148 | A1 | 12/2013 | Ravelli et al. |
| 2013/0332177 | A1 | 12/2013 | Helmrich et al. |
| 2015/0332698 | A1 | 11/2015 | Ravelli et al. |
| 2017/0140769 | A1 | 5/2017 | Ravelli et al. |
| 2017/0309285 | A1 | 10/2017 | Ravelli et al. |
| 2019/0103121 | A1 * | 4/2019 | Ravelli ..... G10L 19/125 |

FOREIGN PATENT DOCUMENTS

| | | | |
|---|---|---|---|
| CN | 1957398 | A | 5/2007 |
| CN | 103000178 | A | 3/2013 |
| CN | 103620672 | A | 3/2014 |
| EP | 732687 | A2 | 9/1996 |
| EP | 1396843 | B1 | 5/2013 |
| JP | 2010530084 | A | 9/2010 |
| JP | 2013531820 | A | 8/2013 |
| JP | 2014510303 | A | 4/2014 |
| RU | 2439721 | C2 | 1/2012 |
| RU | 2483366 | C2 | 5/2013 |
| WO | 2007051548 | A1 | 5/2007 |
| WO | 2012110448 | A1 | 8/2012 |
| WO | 2014118136 | A1 | 8/2014 |

OTHER PUBLICATIONS

ISO/IEC FDIS, "Information Technology—MPEG Audio Technologies—Part 3: Unified Speech and Audio Coding", ISO/IEC JTC 1/SC 29/WG 11, Sep. 20, 2011, 291 pages.

ISO/IEC WD7 of USAC, "International Organisation for Standardisaton Organisation Internationale de Normalization", ISO/IEC JTC1/SC29/WG11 Dresden, Germany, Coding of Moving Pictures and Audio, Apr. 2010, pp. 1-148.

ITU-T, G.718, "Series G: Transmission Systems and Media, Digital Systems and Networks", Digital terminal equipments—Coding of voice and audio signals. Frame error robust narrow-band and wideband embedded variable bit-rate coding of speech and audio from 8-32 kbit/s., Jun. 2008, 257 pages.

Mäkinen, Jari et al., "Low Complex Audio Encoding for Mobile Multimedia", 63rd IEEE Vehicular Technology Conference, Spring, vol. 1,, May 7-10, 2006, pp. 461-465.

* cited by examiner $$SNR = 10 \log_{10} \frac{\sum_{i=1}^{N} x^2(i)}{\sum_{i=1}^{N} (x(i) - y(i))^2}$$

FIG 4A $$SNRseg = \frac{10}{M} \sum_{m=0}^{M-1} \log_{10} \sum_{i=Nm}^{Nm+N-1} \left( \frac{\sum_{i=1}^{N} x^2(i)}{\sum_{i=1}^{N} (x(i) - y(i))^2} \right)$$

FIG 4B

APPARATUS AND METHOD FOR SELECTING ONE OF A FIRST ENCODING ALGORITHM AND A SECOND ENCODING ALGORITHM USING HARMONICS REDUCTION

CROSS-REFERENCE TO RELATED APPLICATIONS

This application is a continuation of U.S. patent application Ser. No. 15/644,040 filed Jul. 7, 2017, now U.S. Pat. No. 10,224,052 issued 5 Mar. 2019, which is a continuation of U.S. patent application Ser. No. 14/947,746 filed Nov. 20, 2015, now U.S. Pat. No. 9,818,421 issued 14 Nov. 2017, which is a continuation of International Application No. PCT/EP2015/066677, filed Jul. 21, 2015, which claims priority from European Application No. EP 14178809.1, filed Jul. 28, 2014, which are each incorporated herein in its entirety by this reference thereto.

BACKGROUND OF THE INVENTION

The present invention relates to audio coding and, in particular, to switched audio coding, where, for different portions of an audio signal, the encoded signal is generated using different encoding algorithms.

Switched audio coders which determine different encoding algorithms for different portions of the audio signal are known. Generally, switched audio coders provide for switching between two different modes, i.e. algorithms, such as ACELP (Algebraic Code Excited Linear Prediction) and TCX (Transform Coded Excitation).

The LPD mode of MPEG USAC (MPEG Unified Speech Audio Coding) is based on the two different modes ACELP and TCX. ACELP provides better quality for speech-like and transient-like signals. TCX provides better quality for music-like and noise-like signals. The encoder decides which mode to use on a frame-by-frame basis. The decision made by the encoder is critical for the codec quality. A single wrong decision can produce a strong artifact, particularly at low-bitrates.

The most-straightforward approach for deciding which mode to use is a closed-loop mode selection, i.e. to perform a complete encoding/decoding of both modes, then compute a selection criteria (e.g. segmental SNR) for both modes based on the audio signal and the coded/decoded audio signals, and finally choose a mode based on the selection criteria. This approach generally produces a stable and robust decision. However, it also necessitates a significant amount of complexity, because both modes have to be run at each frame.

To reduce the complexity an alternative approach is the open-loop mode selection. Open-loop selection consists of not performing a complete encoding/decoding of both modes but instead choose one mode using a selection criteria computed with low-complexity. The worst-case complexity is then reduced by the complexity of the least-complex mode (usually TCX), minus the complexity needed to compute the selection criteria. The savings in complexity is usually significant, which makes this kind of approach attractive when the codec worst-case complexity is constrained.

The AMR-WB+ standard (defined in the International Standard 3GPP TS 26.290 V6.1.0 2004-12) includes an open-loop mode selection, used to decide between all combinations of ACELP/TCX20/TCX40/TCX80 in a 80 ms frame. It is described in Section 5.2.4 of 3GPP TS 26.290. It is also described in the conference paper "Low Complex Audio Encoding for Mobile, Multimedia, VTC 2006, Makinen et al." and U.S. Pat. No. 7,747,430 B2 and U.S. Pat. No. 7,739,120 B2 going back to the author of this conference paper.

U.S. Pat. No. 7,747,430 B2 discloses an open-loop mode selection based on an analysis of long term prediction parameters. U.S. Pat. No. 7,739,120 B2 discloses an open-loop mode selection based on signal characteristics indicating the type of audio content in respective sections of an audio signal, wherein, if such a selection is not viable, the selection is further based on a statistical evaluation carried out for respectively neighboring sections.

The open-loop mode selection of AMR-WB+ can be described in two main steps. In the first main step, several features are calculated on the audio signal, such as standard deviation of energy levels, low-frequency/high-frequency energy relation, total energy, ISP (immittance spectral pair) distance, pitch lags and gains, spectral tilt. These features are then used to make a choice between ACELP and TCX, using a simple threshold-based classifier. If TCX is selected in the first main step, then the second main step decides between the possible combinations of TCX20/TCX40/TCX80 in a closed-loop manner.

WO 2012/110448 A1 discloses an approach for deciding between two encoding algorithms having different characteristics based on a transient detection result and a quality result of an audio signal. In addition, applying a hysteresis is disclosed, wherein the hysteresis relies on the selections made in the past, i.e. for the earlier portions of the audio signal.

In the conference paper "Low Complex Audio Encoding for Mobile, Multimedia, VTC 2006, Makinen et al.", the closed-loop and open-loop mode selection of AMR-WB+ are compared. Subjective listening tests indicate that the open-loop mode selection performs significantly worse than the closed-loop mode selection. But it is also shown that the open-loop mode selection reduces the worst-case complexity by 40%.

SUMMARY

According to an embodiment, an apparatus for selecting one of a first encoding algorithm having a first characteristic and a second encoding algorithm having a second characteristic for encoding a portion of an audio signal to obtain an encoded version of the portion of the audio signal may have: a long-term prediction filter configured to receive the audio signal, to reduce the amplitude of harmonics in the audio signal and to output a filtered version of the audio signal; a first estimator for using the filtered version of the audio signal in estimating a SNR (signal to noise ratio) or a segmental SNR of the portion of the audio signal as a first quality measure for the portion of the audio signal, the first quality measure being associated with the first encoding algorithm, wherein estimating said first quality measure includes performing an approximation of the first encoding algorithm to obtain a distortion estimate of the first encoding algorithm and to estimate the first quality measure based on the portion of the audio signal and the distortion estimate of the first encoding algorithm without actually encoding and decoding the portion of the audio signal using the first encoding algorithm; a second estimator for estimating a SNR or a segmental SNR as a second quality measure for the portion of the audio signal, the second quality measure being associated with the second encoding algorithm, wherein estimating said second quality measure includes performing an approximation of the second encoding algorithm to obtain a distortion estimate of the second encoding algorithm and to estimate the second quality measure using the portion of the audio signal and the distortion estimate of the second encoding algorithm without actually encoding and decoding the portion of the audio signal using the second encoding algorithm; and a controller for selecting the first encoding algorithm or the second encoding algorithm based on a comparison between the first quality measure and the second quality measure, wherein the first encoding algorithm is a transform coding algorithm, a MDCT (modified discrete cosine transform) based coding algorithm or a TCX (transform coding excitation) coding algorithm and wherein the second encoding algorithm is a CELP (code excited linear prediction) coding algorithm or an ACELP (algebraic code excited linear prediction) coding algorithm.

According to another embodiment, an apparatus for encoding a portion of an audio signal may have the inventive apparatus for selecting, a first encoder stage for performing the first encoding algorithm and a second encoder stage for performing the second encoding algorithm, wherein the apparatus for encoding is configured to encode the portion of the audio signal using the first encoding algorithm or the second encoding algorithm depending on the selection by the controller.

According to another embodiment, a system for encoding and decoding may have an inventive apparatus for encoding and a decoder configured to receive the encoded version of the portion of the audio signal and an indication of the algorithm used to encode the portion of the audio signal and to decode the encoded version of the portion of the audio signal using the indicated algorithm.

According to another embodiment, a method for selecting one of a first encoding algorithm having a first characteristic and a second encoding algorithm having a second characteristic for encoding a portion of an audio signal to obtain an encoded version of the portion of the audio signal may have the steps of: filtering the audio signal using a long-term prediction filter to reduce the amplitude of harmonics in the audio signal and to output a filtered version of the audio signal; using the filtered version of the audio signal in estimating a SNR or a segmented SNR of the portion of the audio signal as a first quality measure for the portion of the audio signal, the first quality measure being associated with the first encoding algorithm, wherein estimating said first quality measure includes performing an approximation of the first encoding algorithm to obtain a distortion estimate of the first encoding algorithm and to estimate the first quality measure based on the portion of the first audio signal and the distortion estimate of the first encoding algorithm without actually encoding and decoding the portion of the audio signal using the first encoding algorithm; estimating a SNR or a segmented SNR as a second quality measure for the portion of the audio signal, the second quality measure being associated with the second encoding algorithm, wherein estimating said second quality measure includes performing an approximation of the second encoding algorithm to obtain a distortion estimate of the second encoding algorithm and to estimate the second quality measure using the portion of the audio signal and the distortion estimate of the second encoding algorithm without actually encoding and decoding the portion of the audio signal using the second coding algorithm; and selecting the first encoding algorithm or the second encoding algorithm based on a comparison between the first quality measure and the second quality measure, wherein the first encoding algorithm is a transform coding algorithm, a MDCT (modified discrete cosine transform) based coding algorithm or a TCX (transform coding excitation) coding algorithm and wherein the second encoding algorithm is a CELP (code excited linear prediction) coding algorithm or an ACELP (algebraic code excited linear prediction) coding algorithm.

Another embodiment may have a computer program having a program code for performing, when running on a computer, the inventive method.

Embodiments of the invention provide an apparatus for selecting one of a first encoding algorithm having a first characteristic and a second encoding algorithm having a second characteristic for encoding a portion of an audio signal to obtain an encoded version of the portion of the audio signal, comprising:

a filter configured to receive the audio signal, to reduce the amplitude of harmonics in the audio signal and to output a filtered version of the audio signal;

a first estimator for using the filtered version of the audio signal in estimating a SNR (signal to noise ratio) or a segmented SNR of the portion of the audio signal as a first quality measure for the portion of the audio signal, which is associated with the first encoding algorithm, without actually encoding and decoding the portion of the audio signal using the first encoding algorithm;

a second estimator for estimating a SNR or a segmented SNR as a second quality measure for the portion of the audio signal, which is associated with the second encoding algorithm, without actually encoding and decoding the portion of the audio signal using the second encoding algorithm; and a controller for selecting the first encoding algorithm or the second encoding algorithm based on a comparison between the first quality measure and the second quality measure.

Embodiments of the invention provide a method for selecting one of a first encoding algorithm having a first characteristic and a second encoding algorithm having a second characteristic for encoding a portion of an audio signal to obtain an encoded version of the portion of the audio signal, comprising:

filtering the audio signal to reduce the amplitude of harmonics in the audio signal and to output a filtered version of the audio signal;

using the filtered version of the audio signal in estimating a SNR or a segmental SNR of the portion of the audio signal as a first quality measure for the portion of the audio signal, which is associated with the first encoding algorithm, without actually encoding and decoding the portion of the audio signal using the first encoding algorithm;

estimating a second quality measure for the portion of the audio signal, which is associated with the second encoding algorithm, without actually encoding and decoding the portion of the audio signal using the second encoding algorithm; and selecting the first encoding algorithm or the second encoding algorithm based on a comparison between the first quality measure and the second quality measure.

Embodiments of the invention are based on the recognition that an open-loop selection with improved performance can be implemented by estimating a quality measure for each of first and second encoding algorithms and selecting one of the encoding algorithms based on a comparison between the first and second quality measures. The quality measures are estimated, i.e. the audio signal is not actually encoded and decoded to obtain the quality measures. Thus, the quality measures can be obtained with reduced complexity. The mode selection may then be performed using the estimated quality measures comparable to a closed-loop mode selection. Moreover, the invention is based on the recognition that an improved mode selection can be obtained if the estimation of the first quality measure uses a filtered version of the portion of the audio signal, in which harmonics are reduced when compared to the non-filtered version of the audio signal.

In embodiments of the invention, an open-loop mode selection where the segmental SNR of ACELP and TCX are first estimated with low complexity is implemented. And then the mode selection is performed using these estimated segmental SNR values, like in a closed-loop mode selection.

Embodiments of the invention do not employ a classical features+classifier approach like it is done in the open-loop mode selection of AMR-WB+. But instead, embodiments of the invention try to estimate a quality measure of each mode and select the mode that gives the best quality.

BRIEF DESCRIPTION OF THE DRAWINGS

Embodiments of the present invention will be detailed subsequently referring to the appended drawings, in which:

FIGS. 4*a* and 4*b* possible representations of SNR and segmental SNR.

DETAILED DESCRIPTION OF THE INVENTION

Figure 1:
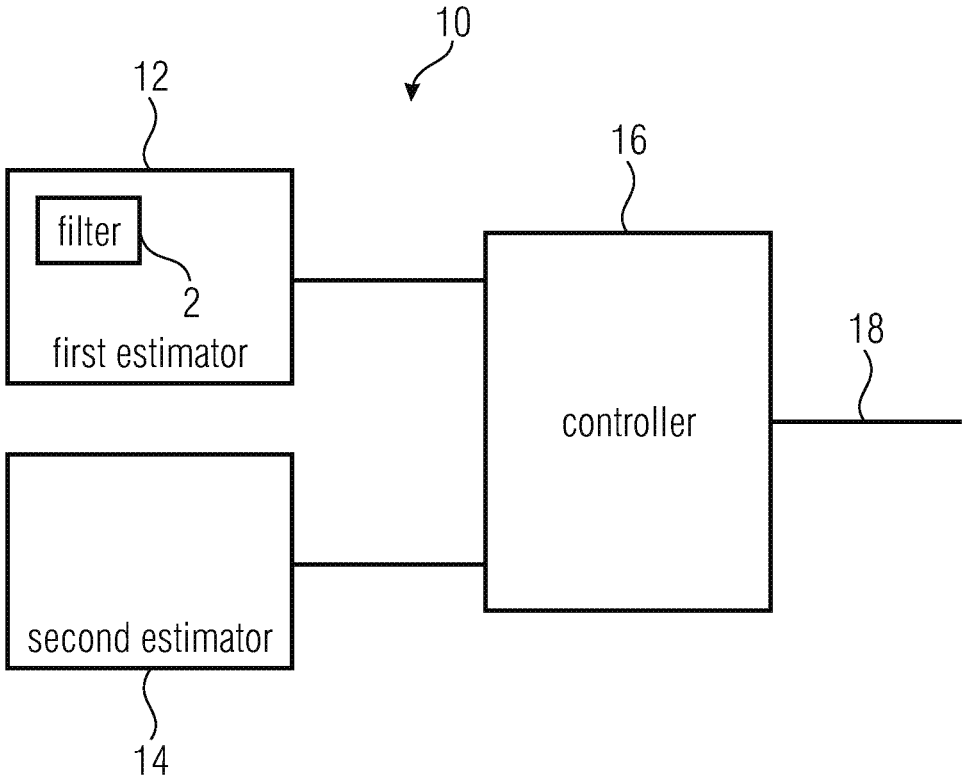
FIG. 1 shows a schematic view of an embodiment of an apparatus for selecting one of a first encoding algorithm and a second encoding algorithm.

In the following description, similar elements/steps in the different drawings are referred to by the same reference signs. It is to be noted that in the drawings features, such as signal connections and the like, which are not necessitated in understanding the invention have been omitted.

FIG. 1 shows an apparatus 10 for selecting one of a first encoding algorithm, such as a TCX algorithm, and a second encoding algorithm, such as an ACELP algorithm, as the encoder for encoding a portion of an audio signal. The apparatus 10 comprises a first estimator 12 for estimating a SNR or a segmental SNR of the portion of the audio signal as first quality measure for the signal portion is provided. The first quality measure is associated with the first encoding algorithm. The apparatus 10 comprises a filter 2 configured to receive the audio signal, to reduce the amplitude of harmonics in the audio signal and to output a filtered version of the audio signal. The filter 2 may be internal to the first estimator 12 as shown in FIG. 1 or may be external to the first estimator 12. The first estimator 12 uses the filtered version of the audio signal in estimating the first quality measure. In other words, the first estimator 12 estimates a first quality measure which the portion of the audio signal would have if encoded and decoded using the first encoding algorithm, without actually encoding and decoding the portion of the audio signal using the first encoding algorithm. The apparatus 10 comprises a second estimator 14 for estimating a second quality measure for the signal portion. The second quality measure is associated with the second encoding algorithm. In other words, the second estimator 14 estimates the second quality measure which the portion of the audio signal would have if encoded and decoded using the second encoding algorithm, without actually encoding and decoding the portion of the audio signal using the second encoding algorithm. Moreover, the apparatus 10 comprises a controller 16 for selecting the first encoding algorithm or the second encoding algorithm based on a comparison between the first quality measure and the second quality measure. The controller may comprise an output 18 indicating the selected encoding algorithm.

In the following specification, the first estimator uses the filtered version of the audio signal, i.e. the filtered version of the portion of the audio signal in estimating the first quality measure if the filter 2 configured to reduce the amplitude of harmonics is provided and is not disabled, even if not explicitly indicated.

In an embodiment, the first characteristic associated with the first encoding algorithm is better suited for music-like and noise-like signals, and the second encoding characteristic associated with the second encoding algorithm is better suited for speech-like and transient-like signals. In embodiments of the invention, the first encoding algorithm is an audio coding algorithm, such as a transform coding algorithm, e.g. a MDCT (modified discrete cosine transform) encoding algorithm, such as a TCX (transform coding excitation) encoding algorithm. Other transform coding algorithms may be based on an FFT transform or any other transform or filterbank. In embodiments of the invention, the second encoding algorithm is a speech encoding algorithm, such as a CELP (code excited linear prediction) coding algorithm, such as an ACELP (algebraic code excited linear prediction) coding algorithm.

In embodiments the quality measure represents a perceptual quality measure. A single value which is an estimation of the subjective quality of the first coding algorithm and a single value which is an estimation of the subjective quality of the second coding algorithm may be computed. The encoding algorithm which gives the best estimated subjective quality may be chosen just based on the comparison of these two values. This is different from what is done in the AMR-WB+standard where many features representing different characteristics of the signal are computed and, then, a classifier is applied to decide which algorithm to choose.

In embodiments, the respective quality measure is estimated based on a portion of the weighted audio signal, i.e. a weighted version of the audio signal. In embodiments, the weighted audio signal can be defined as an audio signal filtered by a weighting function, where the weighting function is a weighted LPC filter $A(z/g)$ with $A(z)$ an LPC filter and g a weight between 0 and 1 such as 0.68. It turned out that good measures of perceptual quality can be obtained in this manner. Note that the LPC filter $A(z)$ and the weighted LPC filter $A(z/g)$ are determined in a pre-processing stage and that they are also used in both encoding algorithms. In other embodiments, the weighting function may be a linear filter, a FIR filter or a linear prediction filter.

In embodiments, the quality measure is the segmental SNR (signal to noise ratio) in the weighted signal domain. It turned out that the segmental SNR in the weighted signal domain represents a good measure of the perceptual quality and, therefore, can be used as the quality measure in a beneficial manner. This is also the quality measure used in both ACELP and TCX encoding algorithms to estimate the encoding parameters.

Another quality measure may be the SNR in the weighted signal domain. Other quality measures may be the segmental SNR, the SNR of the corresponding portion of the audio signal in the non-weighted signal domain, i.e. not filtered by the (weighted) LPC coefficients.

Generally, SNR compares the original and processed audio signals (such as speech signals) sample by sample. Its goal is to measure the distortion of waveform coders that reproduce the input waveform. SNR may be calculated as shown in FIG. 4*a,* where x(i) and y(i) are the original and the processed samples indexed by i and N is the total number of samples. Segmental SNR, instead of working on the whole signal, calculates the average of the SNR values of short segments, such as 1 to 10 ms, such as 5ms. SNR may be calculated as shown in FIG. 4*b,* where N and M are the segment length and the number of segments, respectively.

In embodiments of the invention, the portion of the audio signal represents a frame of the audio signal which is obtained by windowing the audio signal and selection of an appropriate encoding algorithm is performed for a plurality of successive frames obtained by windowing an audio signal. In the following specification, in connection with the audio signal, the terms "portion" and "frame" are used in an exchangeable manner. In embodiments, each frame is divided into subframes and segmental SNR is estimated for each frame by calculating SNR for each subframe, converted in dB and calculating the average of the subframe SNRs in dB.

Thus, in embodiments, it is not the (segmental) SNR between the input audio signal and the decoded audio signal that is estimated, but the (segmental) SNR between the weighted input audio signal and the weighted decoded audio signal is estimated. As far as this (segmental) SNR is concerned, reference can be made to chapter 5.2.3 of the AMR-WB+ standard (International Standard 3GPP TS 26.290 V6.1.0 2004-12).

In embodiments of the invention, the respective quality measure is estimated based on the energy of a portion of the weighted audio signal and based on an estimated distortion introduced when encoding the signal portion by the respective algorithm, wherein the first and second estimators are configured to determine the estimated distortions dependent on the energy of a weighted audio signal.

In embodiments of the invention, an estimated quantizer distortion introduced by a quantizer used in the first encoding algorithm when quantizing the portion of the audio signal is determined and the first quality measure is determined based on the energy of the portion of the weighted audio signal and the estimated quantizer distortion. In such embodiments, a global gain for the portion of the audio signal may be estimated such that the portion of the audio signal would produce a given target bitrate when encoded with a quantizer and an entropy encoder used in the first encoding algorithm, wherein the estimated quantizer distortion is determined based on the estimated global gain. In such embodiments, the estimated quantizer distortion may be determined based on a power of the estimated gain. When the quantizer used in the first encoding algorithm is a uniform scalar quantizer, the first estimator may be configured to determine the estimated quantizer distortion using the formula D=G*G/12, wherein D is the estimated quantizer distortion and G is the estimated global gain. In case the first encoding algorithm uses another quantizer, the quantizer distortion may be determined form the global gain in a different manner.

The inventors recognized that a quality measure, such as a segmental SNR, which would be obtained when encoding and decoding the portion of the audio signal using the first encoding algorithm, such as the TCX algorithm, can be estimated in an appropriate manner by using the above features in any combination thereof.

In embodiments of the invention, the first quality measure is a segmental SNR and the segmental SNR is estimated by calculating an estimated SNR associated with each of a plurality of sub-portions of the portion of the audio signal based on an energy of the corresponding sub-portion of the weighted audio signal and the estimated quantizer distortion and by calculating an average of the SNRs associated with the sub-portions of the portion of the weighted audio signal to obtain the estimated segmental SNR for the portion of the weighted audio signal.

In embodiments of the invention, an estimated adaptive codebook distortion introduced by an adaptive codebook used in the second encoding algorithm when using the adaptive codebook to encode the portion of the audio signal is determined, and the second quality measure is estimated based on an energy of the portion of the weighted audio signal and the estimated adaptive codebook distortion.

In such embodiments, for each of a plurality of sub-portions of the portion of the audio signal, the adaptive codebook may be approximated based on a version of the sub-portion of the weighted audio signal shifted to the past by a pitch-lag determined in a pre-processing stage, an adaptive codebook gain may be estimated such that an error between the sub-portion of the portion of the weighted audio signal and the approximated adaptive codebook is minimized, and an estimated adaptive codebook distortion may be determined based on the energy of an error between the sub-portion of the portion of the weighted audio signal and the approximated adaptive codebook scaled by the adaptive codebook gain.

In embodiments of the invention, the estimated adaptive codebook distortion determined for each sub-portion of the portion of the audio signal may be reduced by a constant factor in order to take into consideration a reduction of the distortion which is achieved by an innovative codebook in the second encoding algorithm.

In embodiments of the invention, the second quality measure is a segmental SNR and the segmental SNR is estimated by calculating an estimated SNR associated with each sub-portion based on the energy the corresponding sub-portion of the weighted audio signal and the estimated adaptive codebook distortion and by calculating an average of the SNRs associated with the sub-portions to obtain the estimated segmental SNR.

In embodiments of the invention, the adaptive codebook is approximated based on a version of the portion of the weighted audio signal shifted to the past by a pitch-lag determined in a pre-processing stage, an adaptive codebook gain is estimated such that an error between the portion of the weighted audio signal and the approximated adaptive codebook is minimized, and the estimated adaptive codebook distortion is determined based on the energy between the portion of the weighted audio signal and the approximated adaptive codebook scaled by the adaptive codebook gain. Thus, the estimated adaptive codebook distortion can be determined with low complexity.

The inventors recognized that the quality measure, such as a segmental SNR, which would be obtained when encoding and decoding the portion of the audio signal using the second encoding algorithm, such as an ACELP algorithm, can be estimated in an appropriate manner by using the above features in any combination thereof.

In embodiments of the invention, a hysteresis mechanism is used in comparing the estimated quality measures. This can make the decision which algorithm is to be used more stable. The hysteresis mechanism can depend on the estimated quality measures (such as the difference therebetween) and other parameters, such as statistics about previous decisions, the number of temporally stationary frames, transients in the frames. As far as such hysteresis mechanisms are concerned, reference can be made to WO 2012/110448 A1, for example.

In embodiments of the invention, an encoder for encoding an audio signal comprises the apparatus 10, a stage for performing the first encoding algorithm and a stage for performing the second encoding algorithm, wherein the encoder is configured to encode the portion of the audio signal using the first encoding algorithm or the second encoding algorithm depending on the selection by the controller 16. In embodiments of the invention, a system for encoding and decoding comprises the encoder and a decoder configured to receive the encoded version of the portion of the audio signal and an indication of the algorithm used to encode the portion of the audio signal and to decode the encoded version of the portion of the audio signal using the indicated algorithm.

Such an open-loop mode selection algorithm as shown in FIG. 1 and described above (except for filter 2) is described in an earlier application PCT/EP2014/051557. This algorithm is used to make a selection between two modes, such as ACELP and TCX, on a frame-by-frame basis. The selection may be based on an estimation of the segmental SNR of both ACELP and TCX. The mode with the highest estimated segmented SNR is selected. Optionally, a hysteresis mechanism can be used to provide a more robust selection. The segmental SNR of ACELP may be estimated using an approximation of the adaptive codebook distortion and an approximation of the innovative codebook distortion. The adaptive codebook may be approximated in the weighted signal domain using a pitch-lag estimated by a pitch analysis algorithm. The distortion may be computed in the weighted signal domain assuming an optimal gain. The distortion may then be reduced by a constant factor, approximating the innovative codebook distortion. The segmental SNR of TCX may be estimated using a simplified version of the real TCX encoder. The input signal may first be transformed with an MDCT, and then shaped using a weighted LPC filter. Finally, the distortion may be estimated in the weighted MDCT domain, using a global gain and a global gain estimator.

It turned out that this open-loop mode selection algorithm as described in the earlier application provides the expected decision most of the time, selecting ACELP on speech-like and transient-like signals and TCX on music-like and noise-like signals. However, the inventors recognized that it might happen that ACELP is sometimes selected on some harmonic music signals. On such signals, the adaptive codebook generally has a high prediction gain, due to the high predictability of harmonic signals, producing low distortion and then higher segmental SNR than TCX. However, TCX sounds better on most harmonic music signals, so TCX should be favored in these cases.

Thus, the present invention suggests to perform the estimation of the SNR or the segmental SNR as the first quality measure using a version of the input signal, which is filtered to reduce harmonics thereof. Thus, an improved mode selection on harmonic music signals can be obtained.

Generally, any suitable filter for reducing harmonics could be used. In embodiments of the invention, the filter is a long-term prediction filter. One simple example of a long-term prediction filter is $$F(z)=1-g\cdot z^{-T}$$

where the filter parameters are the gain "g" and the pitch-lag "T", which are determined from the audio signal.

Embodiments of the invention are based on a long-term prediction filter that is applied to the audio signal before the MDCT analysis in the TCX segmental SNR estimation. The long-term prediction filter reduces the amplitude of the harmonics in the input signal before the MDCT analysis. The consequence is that the distortion in the weighted MDCT domain is reduced, the estimated segmental SNR of TCX is increased, and finally TCX is selected more often on harmonics music signals.

In embodiments of the invention, a transfer function of the long-term prediction filter comprises an integer part of a pitch lag and a multi tap filter depending on a fractional part of the pitch lag. This permits for an efficient implementation since the integer part is used in the normal sampling rate framework ($z^{-T_{int}}$) only. At same time, high accuracy due to the usage of the fractional part in the multi tap filter can be achieved. By considering the fractional part in the multi tap filter removal of the energy of the harmonics can be achieved while removal of energy of portions near the harmonics is avoided.

In embodiments of the invention, the long-term prediction filter is described as follows:

$$P(z)=1-\beta g B(z,T_{fr})z^{-T_{int}}$$

wherein $T_{int}$ and $T_{fr}$ are the integer and fractional part of a pitch-lag, g is a gain, β is a weight, and $B(z,T_{fr})$ is a FIR low-pass filter whose coefficients depend on the fractional part of the pitch lag. Further details on embodiments of such a long-term prediction filter will be set-forth below.

The pitch-lag and the gain may be estimated on a frame-by-frame basis.

The prediction filter can be disabled (gain=0) based on a combination of one or more harmonicity measure(s) (e.g. normalized correlation or prediction gain) and/or one or more temporal structure measure(s) (e.g. temporal flatness measure or energy change).

The filter may be applied to the input audio signal on a frame-by-frame basis. If the filter parameters change from one frame to the next, a discontinuity can be introduced at the border between two frames. In embodiments, the apparatus further comprises a unit for removing discontinuities in the audio signal caused by the filter. To remove the possible discontinuities, any technique can be used, such as techniques comparable to those described in U.S. Pat. No. 5,012,517, EP0732687A2, U.S. Pat. No. 5,999,899A, or U.S. Pat. No. 7,353,168B2. Another technique for removing possible discontinuities is described below.

Figure 2:
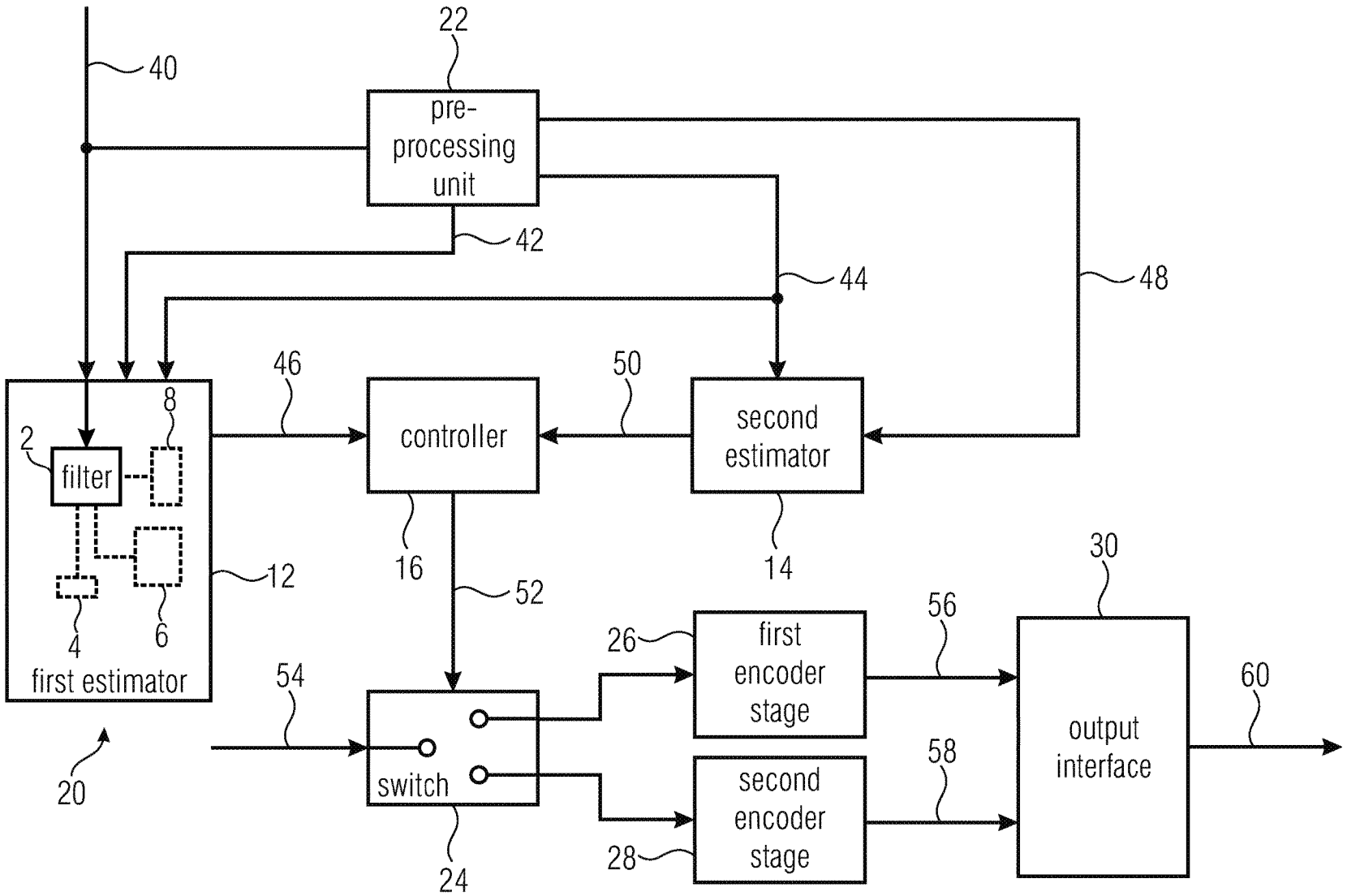
FIG. 2 shows a schematic view of an embodiment of an apparatus for encoding an audio signal.
Figure 3:
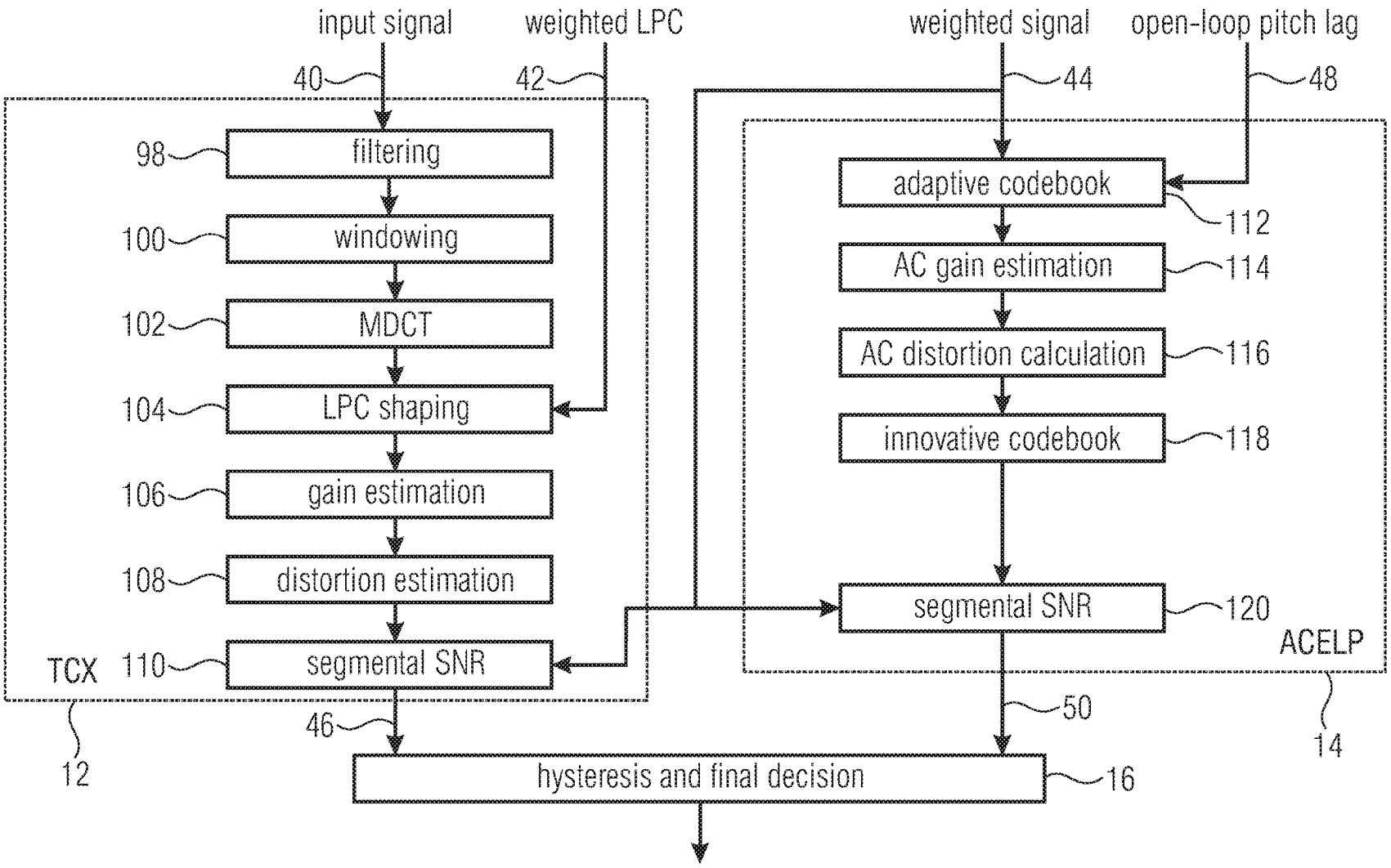
FIG. 3 shows a schematic view of an embodiment of an apparatus for selecting one of a first encoding algorithm and a second encoding algorithm.

Before describing an embodiment of the first estimator 12 and the second estimator 14 in detail referring to FIG. 3, an embodiment of an encoder 20 is described referring to FIG. 2.

The encoder 20 comprises the first estimator 12, the second estimator 14, the controller 16, a pre-processing unit 22, a switch 24, a first encoder stage 26 configured to perform a TCX algorithm, a second encoder stage 28 configured to perform an ACELP algorithm, and an output interface 30. The pre-processing unit 22 may be part of a common USAC encoder and may be configured to output the LPC coefficients, the weighted LPC coefficients, the weighted audio signal, and a set of pitch lags. It is to be noted that all these parameters are used in both encoding algorithms, i.e. the TCX algorithm and the ACELP algorithm. Thus, such parameters have not to be computed for the open-loop mode decision additionally. The advantage of using already computed parameters in the open-loop mode decision is complexity saving.

As shown in FIG. 2, the apparatus comprises the harmonics reduction filter 2. The apparatus further comprises an optional disabling unit 4 for disabling the harmonics reduction filter 2 based on a combination of one or more harmonicity measure(s) (e.g. normalized correlation or prediction gain) and/or one or more temporal structure measure(s) (e.g. temporal flatness measure or energy change). The apparatus comprises an optional discontinuity removal unit 6 for removing discontinuities from the filtered version of the audio signal. In addition, the apparatus optionally comprises a unit 8 for estimating the filter parameters of the harmonics reduction filter 2. In FIG. 2, these components (2, 4, 6, and 8) are shown as being part of the first estimator 12. It goes without saying that these components may be implemented external or separate from the first estimator and may be configured to provide the filtered version of the audio signal to the first estimator.

An input audio signal 40 is provided on an input line. The input audio signal 40 is applied to the first estimator 12, the pre-processing unit 22 and both encoder stages 26, 28. In the first estimator 12, the input audio signal 40 is applied to the filter 2 and the filtered version of the input audio signal is used in estimating the first quality measure. In case the filter is disabled by disabling unit 4, the input audio signal 40 is used in estimating the first quality measure, rather than the filtered version of the input audio signal. The pre-processing unit 22 processes the input audio signal in a conventional manner to derive LPC coefficients and weighted LPC coefficients 42 and to filter the audio signal 40 with the weighted LPC coefficients 42 to obtain the weighted audio signal 44. The pre-processing unit 22 outputs the weighted LPC coefficients 42, the weighted audio signal 44 and a set of pitch-lags 48. As understood by those skilled in the art, the weighted LPC coefficients 42 and the weighted audio signal 44 may be segmented into frames or sub-frames. The segmentation may be obtained by windowing the audio signal in an appropriate manner.

In alternative embodiments, a preprocessor may be provided, which is configured to generate weighted LPC coefficients and a weighted audio signal based on the filtered version of the audio signal. The weighted LPC coefficients and the weighted audio signal, which are based on the filtered version of the audio signal are then applied to the first estimator to estimate the first quality measure, rather than the weighted LPC coefficients 42 and the weighted audio signal 44.

In embodiments of the invention, quantized LPC coefficients or quantized weighted LPC coefficients may be used. Thus, it should be understood that the term "LPC coefficients" is intended to encompass "quantized LPC coefficients" as well, and the term "weighted LPC coefficients" is intended to encompass "weighted quantized LPC coefficients" as well. In this regard, it is worthwhile to note that the TCX algorithm of USAC uses the quantized weighted LPC coefficients to shape the MCDT spectrum.

The first estimator 12 receives the audio signal 40, the weighted LPC coefficients 42 and the weighted audio signal 44, estimates the first quality measure 46 based thereon and outputs the first quality measure to the controller 16. The second estimator 16 receives the weighted audio signal 44 and the set of pitch lags 48, estimates the second quality measure 50 based thereon and outputs the second quality measure 50 to the controller 16. As known to those skilled in the art, the weighted LPC coefficients 42, the weighted audio signal 44 and the set of pitch lags 48 are already computed in a previous module (i.e. the pre-processing unit 22) and, therefore, are available for no cost.

The controller takes a decision to select either the TCX algorithm or the ACELP algorithm based on a comparison of the received quality measures. As indicated above, the controller may use a hysteresis mechanism in deciding which algorithm to be used. Selection of the first encoder stage 26 or the second encoder stage 28 is schematically shown in FIG. 2 by means of switch 24 which is controlled by a control signal 52 output by the controller 16. The control signal 52 indicates whether the first encoder stage 26 or the second encoder stage 28 is to be used. Based on the control signal 52, the necessitated signals schematically indicated by arrow 54 in FIG. 2 and at least including the LPC coefficients, the weighted LPC coefficients, the audio signal, the weighted audio signal, the set of pitch lags are applied to either the first encoder stage 26 or the second encoder stage 28. The selected encoder stage applies the associated encoding algorithm and outputs the encoded representation 56 or 58 to the output interface 30. The output interface 30 may be configured to output an encoded audio signal 60 which may comprise among other data the encoded representation 56 or 58, the LPC coefficients or weighted LPC coefficients, parameters for the selected encoding algorithm and information about the selected encoding algorithm.

Specific embodiments for estimating the first and second quality measures, wherein the first and second quality measures are segmental SNRs in the weighted signal domain are now described referring to FIG. 3. FIG. 3 shows the first estimator 12 and the second estimator 14 and the functionalities thereof in the form of flowcharts showing the respective estimation step-by-step.

Estimation of the TCX Segmental SNR

The first (TCX) estimator receives the audio signal 40 (input signal), the weighted LPC coefficients 42 and the weighted audio signal 44 as inputs. The filtered version of the audio signal 40 is generated, step 98. In the filtered version of the audio signal 40 harmonics are reduced or suppressed.

The audio signal 40 may be analysed to determine one or more harmonicity measure(s) (e.g. normalized correlation or prediction gain) and/or one or more temporal structure measure(s) (e.g. temporal flatness measure or energy change). Based on one of these measures or a combination of these measures, filter 2 and, therefore, filtering 98 may be disabled. If filtering 98 is disabled, estimation of the first quality measure is performed using the audio signal 40 rather than the filtered version thereof.

In embodiments of the invention, a step of removing discontinuities (not shown in FIG. 3) may follow filtering 98 in order to remove discontinuities in the audio signal, which may result from filtering 98.

In step 100, the filtered version of the audio signal 40 is windowed. Windowing may take place with a 10 ms low-overlap sine window. When the past-frame is ACELP, the block-size may be increased by 5 ms, the left-side of the window may be rectangular and the windowed zero impulse response of the ACELP synthesis filter may be removed from the windowed input signal. This is similar as what is done in the TCX algorithm. A frame of the filtered version of the audio signal 40, which represents a portion of the audio signal, is output from step 100.

In step 102, the windowed audio signal, i.e. the resulting frame, is transformed with a MDCT (modified discrete cosine transform). In step 104 spectrum shaping is performed by shaping the MDCT spectrum with the weighted LPC coefficients.

In step 106 a global gain G is estimated such that the weighted spectrum quantized with gain G would produce a given target R, when encoded with an entropy coder, e.g. an arithmetic coder. The term "global gain" is used since one gain is determined for the whole frame.

An example of an implementation of the global gain estimation is now explained. It is to be noted that this global gain estimation is appropriate for embodiments in which the TCX encoding algorithm uses a scalar quantizer with an arithmetic encoder. Such a scalar quantizer with an arithmetic encoder is assumed in the MPEG USAC standard.

Initialization

Firstly, variables used in gain estimation are initialized by:

1. Set en[i]=9.0+10.0* log 10(c[4*i+0]+c[4*i+1]+c[4*i+2]+c[4*i+3]), where 0<=i<L/4, c[] is the vector of coefficients to quantize, and L is the length of c[ ].
2. Set fac=128, offset=fac and target=any value (e.g. 1000)

Iteration

Then, the following block of operations is performed NITER times (e.g. here, NITER=10).

1. fac=fac/2
2. offset=offset−fac
3. ener=0
4. for every i where 0<=i<L/4 do the following: if en[i]-offset>3.0, then ener=ener+en[i]−offset
5. if ener>target, then offset=offset+fac The result of the iteration is the offset value. After the iteration, the global gain is estimated as G=10^(offset/20).

The specific manner in which the global gain is estimated may vary dependent on the quantizer and the entropy coder used. In the MPEG USAC standard a scalar quantizer with an arithmetic encoder is assumed. Other TCX approaches may use a different quantizer and it is understood by those skilled in the art how to estimate the global gain for such different quantizers. For example, the AMR-WB+ standard assumes that a RE8 lattice quantizer is used. For such a quantizer, estimation of the global gain could be estimated as described in chapter 5.3.5.7 on page 34 of 3GPP TS 26.290 V6.1.0 2004-12, wherein a fixed target bitrate is assumed.

After having estimated the global gain in step 106, distortion estimation takes place in step 108. To be more specific, the quantizer distortion is approximated based on the estimated global gain. In the present embodiment it is assumed that a uniform scalar quantizer is used. Thus, the quantizer distortion is determined with the simple formula D=G*G/12, in which D represents the determined quantizer distortion and G represents the estimated global gain. This corresponds to the high-rate approximation of a uniform scalar quantizer distortion.

Based on the determined quantizer distortion, segmental SNR calculation is performed in step 110. The SNR in each sub-frame of the frame is calculated as the ratio of the weighted audio signal energy and the distortion D which is assumed to be constant in the subframes. For example the frame is split into four consecutive sub-frames (see FIG. 4). The segmental SNR is then the average of the SNRs of the four sub-frames and may be indicated in dB.

This approach permits estimation of the first segmental SNR which would be obtained when actually encoding and decoding the subject frame using the TCX algorithm, however without having to actually encode and decode the audio signal and, therefore, with a strongly reduced complexity and reduced computing time.

Estimation of the ACELP Segmental SNR

The second estimator 14 receives the weighted audio signal 44 and the set of pitch lags 48 which is already computed in the pre-processing unit 22.

As shown in step 112, in each sub-frame, the adaptive codebook is approximated by simply using the weighted audio signal and the pitch-lag T. The adaptive codebook is approximated by $$xw(n-T),\ n=0,\ \ldots,\ N$$

wherein xw is the weighted audio signal, T is the pitch-lag of the corresponding subframe and N is the sub-frame length. Accordingly, the adaptive codebook is approximated by using a version of the sub-frame shifted to the past by T. Thus, in embodiments of the invention, the adaptive codebook is approximated in a very simple manner.

In step 114, an adaptive codebook gain for each sub-frame is determined. To be more specific, in each sub-frame, the codebook gain G is estimated such that it minimizes the error between the weighted audio signal and the approximated adaptive-codebook. This can be done by simply comparing the differences between both signals for each sample and finding a gain such that the sum of these differences is minimal.

In step 116, the adaptive codebook distortion for each sub-frame is determined. In each sub-frame, the distortion D introduced by the adaptive codebook is simply the energy of the error between the weighted audio signal and the approximated adaptive-codebook scaled by the gain G.

The distortions determined in step 116 may be adjusted in an optional step 118 in order to take the innovative codebook into consideration. The distortion of the innovative codebook used in ACELP algorithms may be simply estimated as a constant value. In the described embodiment of the invention, it is simply assumed that the innovative codebook reduces the distortion D by a constant factor. Thus, the distortions obtained in step 116 for each sub-frame may be multiplied in step 118 by a constant factor, such as a constant factor in the order of 0 to 1, such as 0.055.

In step 120 calculation of the segmental SNR takes place. In each sub-frame, the SNR is calculated as the ratio of the weighted audio signal energy and the distortion D. The segmental SNR is then the mean of the SNR of the four sub-frames and may be indicated in dB.

This approach permits estimation of the second SNR which would be obtained when actually encoding and decoding the subject frame using the ACELP algorithm, however without having to actually encode and decode the audio signal and, therefore, with a strongly reduced complexity and reduced computing time.

The first and second estimators 12 and 14 output the estimated segmental SNRs 46, 50 to the controller 16 and the controller 16 takes a decision which algorithm is to be used for the associated portion of the audio signal based on the estimated segmental SNRs 46, 50. The controller may optionally use a hysteresis mechanism in order to make the decision more stable. For example, the same hysteresis mechanism as in the closed-loop decision may be used with slightly different tuning parameters. Such a hysteresis mechanism may compute a value "dsnr" which can depend on the estimated segmental SNRs (such as the difference therebetween) and other parameters, such as statistics about previous decisions, the number of temporally stationary frames, and transients in the frames.

Without a hysteresis mechanism, the controller may select the encoding algorithm having the higher estimated SNR, i.e. ACELP is selected if the second estimated SNR is higher less than the first estimated SNR and TCX is selected if the first estimated SNR is higher than the second estimated SNR. With a hysteresis mechanism, the controller may select the encoding algorithm according to the following decision rule, wherein acelp_snr is the second estimated SNR and tcx_snr is the first estimated SNR:

if acelp_snr+dsnr>tcx_snr then select ACELP, otherwise select TCX.

Determination of the Parameters of the Filter for Reducing the Amplitude of the Harmonics An embodiment for determining the parameters of the filter for reducing the amplitude of the harmonics is now described. The filter parameters may be estimated at the encoder-side, such as in unit 8.

Pitch Estimation

One pitch lag (integer part+fractional part) per frame is estimated (frame size e.g. 20 ms). This is done in three steps to reduce complexity and to improve estimation accuracy.

a) First Estimation of the integer part of the pitch lag

A pitch analysis algorithm that produces a smooth pitch evolution contour is used (e.g. Open-loop pitch analysis described in Rec. ITU-T G.718, sec. 6.6). This analysis is generally done on a subframe basis (subframe size e.g. 10 ms), and produces one pitch lag estimate per subframe. Note that these pitch lag estimates do not have any fractional part and are generally estimated on a downsampled signal (sampling rate e.g. 6400 Hz). The signal used can be any audio signal, e.g. a LPC weighted audio signal as described in Rec. ITU-T G.718, sec. 6.5.

b) Refinement of the integer part $T_{int}$ of the pitch lag

The final integer part of the pitch lag is estimated on an audio signal x[n] running at the core encoder sampling rate, which is generally higher than the sampling rate of the downsampled signal used in a) (e.g. 12.8 kHz, 16 kHz, 32 kHz . . . ). The signal x[n] can be any audio signal e.g. a LPC weighted audio signal.

The integer part $T_{int}$ of the pitch lag is then the lag that maximizes the autocorrelation function $$C(d) = \sum_{n=0}^{N} x[n]x[n-d]$$

with d around a pitch lag T estimated in a).

$$T-\delta_1 \le d \le T+\delta_2$$

c) Estimation of the fractional part $T_{fr}$ of the pitch lag

The fractional part $T_{fr}$ is found by interpolating the autocorrelation function C(d) computed in step b) and selecting the fractional pitch lag which maximizes the interpolated autocorrelation function. The interpolation can be performed using a low-pass FIR filter as described in e.g. Rec. ITU-T G.718, sec. 6.6.7.

Gain Estimation and Quantization

The gain is generally estimated on the input audio signal at the core encoder sampling rate, but it can also be any audio signal like the LPC weighted audio signal. This signal is noted y[n] and can be the same or different than x[n].

The prediction $y_p[n]$ of y[n] is first found by filtering y[n] with the following filter $$P(z)=B(z,T_{fr})z^{-T_{int}}$$

with $T_{int}$ the integer part of the pitch lag (estimated in b)) and B(z, $T_{fr}$) a low-pass FIR filter whose coefficients depend on the fractional part of the pitch lag $T_{fr}$ (estimated in c)).

One example of B(z) when the pitch lag resolution is ¼:

$$T_{fr}=0/4\ B(z)=0.0000z^{-2}+0.2325z^{-1}+0.5349z^{0}+0.2325z^{1}$$

$$T_{fr}=1/4\ B(z)=0.0152z^{-2}+0.3400z^{-1}+0.5094z^{0}+0.1353z^{1}$$

$$T_{fr}=2/4\ B(z)=0.0609z^{-2}+0.4391z^{-1}+0.4391z^{0}+0.0609z^{1}$$

$$T_{fr}=3/4\ B(z)=0.1353z^{-2}+0.5094z^{-1}+0.3400z^{0}+0.0152z^{1}$$

The gain g is then computed as follows:

$$g = \frac{\sum_{n=0}^{N-1} y[n]y_P[n]}{\sum_{n=0}^{N-1} y_P[n]y_P[n]}$$

and limited between 0 and 1.

Finally, the gain g is quantized e.g. on 2 bits, using e.g. uniform quantization.

β is used to control the strength of the filter. β equal to 1 produces full effects. β equal to 0 disables the filter. Thus, in embodiments of the invention, the filter may be disabled by setting β to a value of 0. In embodiments of the invention, if the filter is enabled, β may be set to a value between 0,5 and 0,75. In embodiments of the invention, if the filter is enabled, β may be set to a value of 0,625. An example of B(z, $T_{fr}$) is given above. The order and the coefficients of B(z, $T_{fr}$) can also depend on the bitrate and the output sampling rate. A different frequency response can be designed and tuned for each combination of bitrate and output sampling rate.

Disabling the Filter

The filter may be disabled based on a combination of one or more harmonicity measure(s) and/or one or more temporal structure measure(s). Examples of such a measures are described below:

i) Harmonicity measure like the normalized correlation at the integer pitch-lag estimated in step b).

$$norm.\ corr. = \frac{\sum_{n=0}^{N} x[n]x[n-T_{int}]}{\sqrt{\sum_{n=0}^{N} x[n]x[n]}\sqrt{\sum_{n=0}^{N} x[n-T_{int}]x[n-T_{int}]}}$$

The normalized correlation is 1 if the input signal is perfectly predictable by the integer pitch-lag, and 0 if it is not predictable at all. A high value (close to 1) would then indicate a harmonic signal. For a more robust decision, the normalized correlation of the past frame can also be used in the decision, e.g.:

If (norm.corr(curr.)*norm.corr.(prev.))>0.25, then the filter is not disabled ii) Temporal structure measures computed, for example, on the basis of energy samples also used by a transient detector for transient detection (e.g. temporal flatness measure, energy change), e.g.

if (temporal flatness measure>3.5 or energy change>3.5) then the filter is disabled.

More details concerning determination of one or more harmonicity measures are set forth below.

The measure of harmonicity is, for example, computed by a normalized correlation of the audio signal or a pre-modified version thereof at or around the pitch-lag. The pitch-lag could even be determined in stages comprising a first stage and a second stage, wherein, within the first stage, a preliminary estimation of the pitch-lag is determined at a down-sampled domain of a first sample rate and, within the second stage, the preliminary estimation of the pitch-lag is refined at a second sample rate, higher than the first sample rate. The pitch-lag is, for example, determined using auto-correlation. The at least one temporal structure measure is, for example, determined within a temporal region temporally placed depending on the pitch information. A temporally past-heading end of the temporal region is, for example, placed depending on the pitch information. The temporal past-heading end of the temporal region may be placed such that the temporally past-heading end of the temporal region is displaced into past direction by a temporal amount monotonically increasing with an increase of the pitch information. The temporally future-heading end of the temporal region may be positioned depending on the temporal structure of the audio signal within a temporal candidate region extending from the temporally past-heading end of the temporal region or, of the region of higher influence onto the determination of the temporal structure measure, to a temporally future-heading end of a current frame. The amplitude or ratio between maximum and minimum energy samples within the temporal candidate region may be used to this end. For example, the at least one temporal structure measure may measure an average or maximum energy variation of the audio signal within the temporal region and a condition of disablememt may be met if both the at least one temporal structure measure is smaller than a predetermined first threshold and the measure of harmonicity is, for a current frame and/or a previous frame, above a second threshold. The condition is also by met if the measure of harmonicity is, for a current frame, above a third threshold and the measure of harmonicity is, for a current frame and/or a previous frame, above a fourth threshold which decreases with an increase of the pitch lag.

A step-by-step description of a concrete embodiment for determining the measures is presented now.

Step 1. Transient Detection and Temporal Measures

The input signal $s_{HP}(n)$ is input to the time-domain transient detector. The input signal $s_{HP}(n)$ is high-pass filtered. The transfer function of the transient detection's HP filter is given by $$H_{TD}(z)=0.375-0.5z^{-1}+0.125z^{-2} \tag{1}$$

The signal, filtered by the transient detection's HP filter, is denoted as $s_{TD}(n)$. The HP-filtered signal $s_{TD}(n)$ is segmented into 8 consecutive segments of the same length. The energy of the HP-filtered signal $s_{TD}(n)$ for each segment is calculated as:

$$E_{TD}(i) = \sum_{n=0}^{L_{segment}-1} (s_{TD}(iL_{segment}+n))^2,\ i = 0, \ldots, 7 \tag{2}$$

where $$L_{segment} = \frac{L}{8}$$

is the number of samples in 2.5 milliseconds segment at the input sampling frequency.

An accumulated energy is calculated using:

$$E_{Acc}=\max(E_{TD}(i-1),0.8125E_{Acc}) \tag{3}$$

An attack is detected if the energy of a segment $E_{TD}(i)$ exceeds the accumulated energy by a constant factor attackRatio=8.5 and the attackIndex is set to i :

$$E_{TD}(i)>\text{attackRatio}\cdot E_{Acc} \tag{4}$$

If no attack is detected based on the criteria above, but a strong energy increase is detected in segment i, the attackIndex is set to i without indicating the presence of an attack. The attackIndex is basically set to the position of the last attack in a frame with some additional restrictions.

The energy change for each segment is calculated as:

$$E_{chng}(i) = \begin{cases} \dfrac{E_{TD}(i)}{E_{TD}(i-1)}, & E_{TD}(i) > E_{TD}(i-1) \\ \dfrac{E_{TD}(i-1)}{E_{TD}(i)}, & E_{TD}(i-1) > E_{TD}(i) \end{cases} \tag{5}$$

The temporal flatness measure is calculated as:

$$TFM(N_{past}) = \frac{1}{8+N_{past}} \sum_{i=-N_{past}}^{7} E_{chng}(i) \tag{6}$$

The maximum energy change is calculated as:

$$MEC(N_{past},N_{new})=\max(E_{chng}(-N_{past}),E_{chng}(-N_{past}+1), \ldots, E_{chng}(N_{new}-1)) \tag{7}$$

If index of $E_{chng}(i)$ or $E_{TD}(i)$ is negative then it indicates a value from the previous segment, with segment indexing relative to the current frame.

$N_{past}$ is the number of the segments from the past frames. It is equal to 0 if the temporal flatness measure is calculated for the usage in ACELP/TCX decision. If the temporal flatness measure is calculated for the TCX LTP decision then it is equal to:

$$N_{past} = 1 + \min\left(8, \left\lceil 8\frac{\text{pitch}}{L} + 0.5 \right\rceil\right) \tag{8}$$

(8)

$N_{new}$ is the number of segments from the current frame. It is equal to 8 for non-transient frames. For transient frames first the locations of the segments with the maximum and the minimum energy are found:

$$i_{max} = \underset{i\in\{-N_{past},\ldots,7\}}{\arg\max}\ E_{TD}(i) \tag{9}$$

$$i_{min} = \underset{i\in\{-N_{past},\ldots,7\}}{\arg\min}\ E_{TD}(i) \tag{10}$$

If $E_{TD}(i_{min})>0.375E_{TD}(i_{max})$ then $N_{new}$ is set to $i_{max}-3$, otherwise $N_{new}$ is set to 8.

Step 2. Transform Block Length Switching

The overlap length and the transform block length of the TCX are dependent on the existence of a transient and its location.

TABLE 1

Coding of the overlap and the transform length based on the transient position

| Attack-Index | Overlap with the first window of the following frame | Short/Long Transform decision (binary coded) 0—Long, 1—Short | Binary code for the overlap width | Overlap code |
|---|---|---|---|---|
| none | ALDO | 0 | 0 | 00 |
| −2 | FULL | 1 | 0 | 10 |
| −1 | FULL | 1 | 0 | 10 |
| 0 | FULL | 1 | 0 | 10 |
| 1 | FULL | 1 | 0 | 10 |
| 2 | MINIMAL | 1 | 10 | 110 |
| 3 | HALF | 1 | 11 | 111 |
| 4 | HALF | 1 | 11 | 111 |
| 5 | MINIMAL | 1 | 10 | 110 |
| 6 | MINIMAL | 0 | 10 | 010 |
| 7 | HALF | 0 | 11 | 011 |

The transient detector described above basically returns the index of the last attack with the restriction that if there are multiple transients then MINIMAL overlap is favored over HALF overlap which is favored over FULL overlap. If an attack at position 2 or 6 is not strong enough then HALF overlap is chosen instead of the MINIMAL overlap.

Step 3. Pitch Estimation

One pitch lag (integer part+fractional part) per frame is estimated (frame size e.g. 20 ms) as set forth above in 3 steps a) to c) to reduce complexity and improves estimation accuracy.

Step 4. Decision Bit

If the input audio signal does not contain any harmonic content or if a prediction based technique would introduce distortions in time structure (e.g. repetition of a short transient), then a decision that the filter is disabled is taken.

The decision is made based on several parameters such as the normalized correlation at the integer pitch-lag and the temporal structure measures.

The normalized correlation at the integer pitch-lag norm corr is estimated as set forth above. The normalized correlation is 1 if the input signal is perfectly predictable by the integer pitch-lag, and 0 if it is not predictable at all. A high value (close to 1) would then indicate a harmonic signal. For a more robust decision, beside the normalized correlation for the current frame (norm_corr(curr)) the normalized correlation of the past frame (norm_corr(prev)) can also be used in the decision., e.g.:

If (norm_corr(curr)*norm_corr(prev))>0.25 or

If max(norm_corr(curr),norm_corr(prev))>0.5, then the current frame contains some harmonic content.

The temporal structure measures may be computed by a transient detector (e.g. temporal flatness measure (equation (6)) and maximal energy change equation (7)), to avoid activating the filter on a signal containing a strong transient or big temporal changes. The temporal features are calculated on the signal containing the current frame ($N_{new}$ segments) and the past frame up to the pitch lag ($N_{past}$ segments). For step like transients that are slowly decaying, all or some of the features are calculated only up to the location of the transient $i_{max}-3$) because the distortions in the non-harmonic part of the spectrum introduced by the LTP filtering would be suppressed by the masking of the strong long lasting transient (e.g. crash cymbal).

Pulse trains for low pitched signals can be detected as a transient by a transient detector. For the signals with low pitch the features from the transient detector are thus ignored and there is instead additional threshold for the normalized correlation that depends on the pitch lag, e.g.:

If norm_corr<=$1.2-T_{int}/L$, then disable the filter.

One example decision is shown below where b1 is some bitrate, for example 48 kbps, where TCX_20 indicates that the frame is coded using single long block, where TCX_10 indicates that the frame is coded using 2,3,4 or more short blocks, where TCX_20/TCX_10 decision is based on the output of the transient detector described above. tempFlatness is the Temporal Flatness Measure as defined in (6), maxEnergyChange is the Maximum Energy Change as defined in (7). The condition norm_corr(curr)>$1.2-T_{int}/L$ could also be written as (1.2−norm_corr(curr))*L<$T_{int}$.

```
enableLTP =
(bitrate< b1 && tcxMode==TCX_20 && (norm_corr(curr) *
norm_corr(prev)) > 0.25 && tempFlatness < 3.5) ||
(bitrate>=b1 && tcxMode==TCX_10 &&
max(norm_corr(curr),norm_corr(prev)) > 0.5 &&
maxEnergyChange<3.5) ||
(bitrate >= b1 && norm_corr(curr) > 0.44 && norm_corr(curr) >
1.2-T_int/L) ||
(bitrate >= b1 && tcxMode == TCX_20 && norm_corr(curr) > 0.44
&&
    (tempFlatness < 6.0 || (tempFlatness < 7.0 && maxEnergyChange <
    22.0)));
    ( bitrate >= b1 && tcxMode == TCX_20 && norm_corr > 0.44
    &&
```

It is obvious from the examples above that the detection of a transient affects which decision mechanism for the long term prediction will be used and what part of the signal will be used for the measurements used in the decision, and not that it directly triggers disabling of the long term prediction filter.

The temporal measures used for the transform length decision may be completely different from the temporal measures used for the LTP filter decision or they may overlap or be exactly the same but calculated in different regions. For low pitched signals the detection of transients may be ignored completely if the threshold for the normalized correlation that depends on the pitch lag is reached.

Technique for Removing Possible Discontinuities

A possible technique for removing discontinuities caused by applying a linear filter H(z) frame by frame is now described. The linear filter may be the LTP filter described. The linear filter may be a FIR (finite impulse response) filter or an IIR (infinite impulse response) filter. The proposed approach does not filter a portion of the current frame with the filter parameters of the past frame, and thus avoids possible problems of known approaches. The proposed approach uses a LPC filter to remove the discontinuity. This LPC filter is estimated on the audio signal (filtered by a linear time-invariant filter H(z) or not) and is thus a good model of the spectral shape of the audio signal (filtered by H(z) or not). The LPC filter is then used such that the spectral shape of the audio signal masks the discontinuity.

The LPC filter can be estimated in different ways. It can be estimated e.g. using the audio signal (current and/or past frame) and the Levinson-Durbin algorithm. It can also be computed on the past filtered frame signal, using the Levinson-Durbin algorithm.

If H(z) is used in an audio codec and the audio codec already uses a LPC filter (quantized or not) to e.g. shape the quantization noise in a transform-based audio codec, then this LPC filter can be directly used for smoothing the discontinuity, without the additional complexity needed to estimate a new LPC filter.

Below is described the processing of the current frame for the FIR filter case and the IIR filter case. The past frame is assumed to be already processed.

FIR Filter Case:

1. Filter the current frame with the filter parameters of the current frame, producing a filtered current frame.
2. Considering a LPC filter (quantized or not) with order M, estimated on the audio signal (filtered or not).
3. The M last samples of the past frame are filtered with the filter H(z) and the coefficients of the current frame, producing a first portion of filtered signal.
4. The M last samples of the filtered past frame are then subtracted from the first portion of filtered signal, producing a second portion of filtered signal.
5. A Zero Impulse Response (ZIR) of the LPC filter is then generated by filtering a frame of zero samples with the LPC filter and initial states equal to the second portion of filtered signal.
6. The ZIR can be optionally windowed such that its amplitude goes faster to 0.
7. A beginning portion of the ZIR is subtracted from a corresponding beginning portion of the filtered current frame.

IIR Filter Case:

1. Considering a LPC filter (quantized or not) with order M, estimated on the audio signal (filtered or not).
2. The M last samples of the past frame are filtered with the filter H(z) and the coefficients of the current frame, producing a first portion of filtered signal.
3. The M last samples of the filtered past frame are then subtracted from the first portion of filtered signal, producing a second portion of filtered signal.
4. A Zero Impulse Response (ZIR) of the LPC filter is then generated by filtering a frame of zero samples with the LPC filter and initial states equal to the second portion of filtered signal.
5. The ZIR can be optionally windowed such that its amplitude goes faster to 0.
6. A beginning portion of the current frame is then processed sample-by-sample starting with the first sample of the current frame.
7. The sample is filtered with the filter H(z) and the current frame parameters, producing a first filtered sample.
8. The corresponding sample of the ZIR is then subtracted from the first filtered sample, producing the corresponding sample of the filtered current frame.
9. Move to the next sample.
10. Repeat 7 to 9 until the last sample of the beginning portion of the current frame is processed.
11. Filter the remaining samples of the current frame with the filter parameters of the current frame.

Accordingly, embodiments of the invention permit for estimating segmental SNRs and selection of an appropriate encoding algorithm in a simple and accurate manner. In particular, embodiments of the invention permit for an open-loop selection of an appropriate coding algorithm, wherein inappropriate selection of a coding algorithm in case of an audio signal having harmonics is avoided.

In the above embodiments, the segmental SNRs are estimated by calculating an average of SNRs estimated for respective sub-frames. In alternative embodiments, the SNR of a whole frame could be estimated without dividing the frame into sub-frames.

Embodiments of the invention permit for a strong reduction in computing time when compared to a closed-loop selection since a number of steps necessitated in the closed-loop selection are omitted.

Accordingly, a large number of steps and the computing time associated therewith can be saved by the inventive approach while still permitting selection of an appropriate encoding algorithm with good performance.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Embodiments of the apparatuses described herein and the features thereof may be implemented by a computer, one or more processors, one or more micro-processors, field-programmable gate arrays (FPGAs), application specific integrated circuits (ASICs) and the like or combinations thereof, which are configured or programmed in order to provide the described functionalities.

Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a non-transitory storage medium such as a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or programmed to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver .

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Apparatus for selecting one of a first encoding algorithm having a first characteristic and a second encoding algorithm having a second characteristic for encoding a portion of an audio signal to obtain an encoded version of the portion of the audio signal, comprising:

a long-term prediction filter configured to receive the audio signal, to reduce the amplitude of harmonics in the audio signal and to output a filtered version of the audio signal;

a first estimator to estimate a segmental signal to noise ratio of the portion of the audio signal as a first quality measure of the portion of the audio signal, the first quality measure being associated with the first encoding algorithm, wherein the first estimator is to transform the filtered version of the audio signal with a modified discrete cosine transform, MDCT, to shape the transformed filtered version of the audio signal using a weighted linear prediction coding, LPC, filter, and to estimate a first distortion in the weighted MDCT domain using a global gain estimator;

a second estimator to estimate a segmental signal to noise ratio of the portion of the audio signal as a second quality measure of the portion of the audio signal, the second quality measure being associated with the second encoding algorithm, wherein the second estimator is to use an approximation of an adaptive codebook distortion and an approximation of an innovative codebook distortion, wherein the adaptive codebook is approximated in the weighted signal domain using a pitch-lag estimated by a pitch analysis algorithm, wherein a second distortion is computed in the weighted signal domain assuming an optimal gain and wherein the second distortion is then reduced by a constant factor, approximating the innovative codebook distortion;

a controller for selecting the first encoding algorithm or the second encoding algorithm based on a comparison between the first quality measure and the second quality measure, wherein the first encoding algorithm is a transform coding algorithm, a MDCT based coding algorithm or a transform coding excitation, TCX, coding algorithm and wherein the second encoding algorithm is a code excited linear prediction, CELP, coding algorithm or an algebraic code excited linear prediction, ACELP, coding algorithm.

2. Apparatus of claim 1, wherein a transfer function of the long-term prediction filter comprises an integer part of a pitch lag and a multi tap filter depending on a fractional part of the pitch lag.

3. Apparatus of claim 1, wherein the long-term prediction filter has the transfer function:

$$P(z)=1-\beta g B(z,T_{fr})z^{-T}$$

with $T_{int}$ and $T_{fr}$ are the integer and fractional part of a pitch-lag, g is a gain, β is a weight and $B(z,T_{fr})$ is a FIR low-pass filter whose coefficients depend on the fractional part of the pitch.

4. Apparatus of claim 1, further comprising a disabling unit for disabling the filter based on a combination of one or more harmonicity measures and/or one or more temporal structure measures.

5. Apparatus of claim 4, wherein the one or more harmonicity measures comprise at least one of a normalized correlation or a prediction gain and wherein the one or more temporal structure measures comprise at least one of a temporal flatness measure and an energy change.

6. Apparatus of claim 5, wherein the filter is applied to the audio signal on a frame-by-frame basis, said apparatus further comprising a unit for removing discontinuities in the audio signal caused by the filter.

7. Apparatus of claim 1, wherein the first estimator is configured to determine an estimated quantizer distortion which a quantizer used in the first encoding algorithm would introduce when quantizing the portion of the audio signal and to estimate the first quality measure based on an energy of a portion of a weighted version of the audio signal and the estimated quantizer distortion, wherein the first estimator is configured to estimate the global gain for the portion of the audio signal such that the portion of the audio signal would produce a given target bitrate when encoded with a quantizer and an entropy coder used in the first encoding algorithm, wherein the first estimator is further configured to determine the estimated quantizer distortion based on the estimated global gain.

8. Apparatus of claim 7, wherein the second estimator is configured to determine the estimated adaptive codebook distortion which an adaptive codebook used in the second encoding algorithm would introduce when using the adaptive codebook to encode the portion of the audio signal, and wherein the second estimator is configured to estimate the second quality measure based on an energy of a portion of a weighted version of the audio signal and the estimated adaptive codebook distortion, wherein, for each of a plurality of sub-portions of the portion of the audio signal, the second estimator is configured to approximate the adaptive codebook based on a version of the sub-portion of the weighted audio signal shifted to the past by a pitch-lag determined in a pre-processing stage, to estimate an adaptive codebook gain such that an error between the sub-portion of the portion of the weighted audio signal and the approximated adaptive codebook is minimized, and to determine the estimated adaptive codebook distortion based on the energy of an error between the sub-portion of the portion of the weighted audio signal and the approximated adaptive codebook scaled by the adaptive codebook gain.

9. Apparatus of claim 8, wherein the second estimator is further configured to reduce the estimated adaptive codebook distortion determined for each sub-portion of the portion of the audio signal by a second constant factor.

10. Apparatus of claim 1, wherein the second estimator is configured to determine the estimated adaptive codebook distortion which an adaptive codebook used in the second encoding algorithm would introduce when using the adaptive codebook to encode the portion of the audio signal, and wherein the second estimator is configured to estimate the second quality measure based on an energy of a portion of a weighted version of the audio signal and the estimated adaptive codebook distortion, wherein the second estimator is configured to approximate the adaptive codebook based on a version of the portion of the weighted audio signal shifted to the past by a pitch-lag determined in a pre-processing stage, to estimate an adaptive codebook gain such that an error between the portion of the weighted audio signal and the approximated adaptive codebook is minimized, and to determine the estimated adaptive codebook distortion based on the energy of an error between the portion of the weighted audio signal and the approximated adaptive codebook scaled by the adaptive codebook gain.

11. Apparatus for encoding a portion of an audio signal, comprising the apparatus according to claim 1, a first encoder stage for performing the first encoding algorithm and a second encoder stage for performing the second encoding algorithm, wherein the apparatus for encoding is configured to encode the portion of the audio signal using the first encoding algorithm or the second encoding algorithm depending on the selection by the controller.

12. System for encoding and decoding comprising an apparatus for encoding according to claim 11 and a decoder configured to receive the encoded version of the portion of the audio signal and an indication of the algorithm used to encode the portion of the audio signal and to decode the encoded version of the portion of the audio signal using the indicated algorithm.

13. Method for selecting one of a first encoding algorithm having a first characteristic and a second encoding algorithm having a second characteristic for encoding a portion of an audio signal to obtain an encoded version of the portion of the audio signal, comprising:

filtering the audio signal using a long-term prediction filter to reduce the amplitude of harmonics in the audio signal and to output a filtered version of the audio signal;

estimating a segmental signal to noise ratio of the portion of the audio signal as a first quality measure of the portion of the audio signal, the first quality measure being associated with the first encoding algorithm, comprising: transforming the filtered version of the audio signal with a modified discrete cosine transform, MDCT, shaping the transformed filtered version of the audio signal using a weighted linear prediction coding, LPC, filter, and estimating a first distortion in the weighted MDCT domain using a global gain estimator;

estimating a segmental signal to noise ratio of the portion of the audio signal as a second quality measure of the portion of the audio signal, the second quality measure being associated with the second encoding algorithm, comprising: using an approximation of an adaptive codebook distortion and an approximation of an innovative codebook distortion, wherein the adaptive codebook is approximated in the weighted signal domain using a pitch-lag estimated by a pitch analysis algorithm, wherein a second distortion is computed in the weighted signal domain assuming an optimal gain and wherein the second distortion is then reduced by a constant factor, approximating the innovative codebook distortion; and selecting the first encoding algorithm or the second encoding algorithm based on a comparison between the first quality measure and the second quality measure, wherein the first encoding algorithm is a transform coding algorithm, a modified discrete cosine transform, MDCT, based coding algorithm or a transform coding excitation, TCX, coding algorithm and wherein the second encoding algorithm is a code excited linear prediction, CELP, coding algorithm or an algebraic code excited linear prediction, ACELP, coding algorithm.

14. A non-transitory computer-readable storing program code for perform, when running on a computer, the method of claim 13.

* * * * *